US007866802B2

(12) United States Patent
Nozawa et al.

(10) Patent No.: US 7,866,802 B2
(45) Date of Patent: Jan. 11, 2011

(54) LIQUID EJECTING APPARATUS

(75) Inventors: Izumi Nozawa, Matsumoto (JP); Hitoshi Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 12/394,190

(22) Filed: Feb. 27, 2009

(65) Prior Publication Data

US 2009/0219336 A1 Sep. 3, 2009

(30) Foreign Application Priority Data

Feb. 28, 2008 (JP) ..... 2008-047313

(51) Int. Cl.
*B41J 2/175* (2006.01)

(52) U.S. Cl. ..... 347/85; 347/38

(58) Field of Classification Search ..... 347/29–36, 347/20, 38, 84–86
See application file for complete search history.

(56) References Cited

U.S. PATENT DOCUMENTS 4,383,263 A * 5/1983 Ozawa et al. ..... 347/30
4,506,277 A * 3/1985 Terasawa ..... 347/24
4,819,012 A * 4/1989 Kiyohara et al. ..... 347/30
4,847,637 A * 7/1989 Watanabe et al. ..... 347/30
6,027,205 A * 2/2000 Herbert ..... 347/54
6,260,953 B1 * 7/2001 Silverbrook et al. ..... 347/54
6,312,094 B1 * 11/2001 Ito et al. ..... 347/36
6,477,956 B1 * 11/2002 Rea et al. ..... 101/466
7,506,966 B2 * 3/2009 Silverbrook ..... 347/54
2008/0012923 A1 * 1/2008 Silverbrook ..... 347/108

FOREIGN PATENT DOCUMENTS

JP 05-112015 5/1993
JP 10-100449 4/1998
JP 2001-322297 11/2001
JP 2006-150668 6/2006

* cited by examiner

*Primary Examiner*—Charlie Peng
*Assistant Examiner*—Peter Radkowski
(74) *Attorney, Agent, or Firm*—Workman Nydegger

(57) ABSTRACT

A liquid ejecting apparatus includes: a sub-tank which stores a certain volume of liquid; a liquid ejecting head which ejects the liquid supplied from the sub-tank; a sheet feeding drum which feeds an ejection target medium to be ejected with the liquid by rotation; a liquid container which stores the liquid to be supplied to the sub-tank; and a supply passage which connects the sub-tank to the liquid container so that the liquid is supplied from the liquid container to the sub-tank. The sheet feeding drum includes a liquid container receiving chamber receiving the liquid container and the liquid container receiving chamber communicates with the supply passage.

7 Claims, 4 Drawing Sheets

LIQUID EJECTING APPARATUS

The entire disclosure of Japanese Patent Application No. 2008-047313, filed Feb. 28, 2008, is expressly incorporated herein by reference.

BACKGROUND

1. Technical Field

The present invention relates to a liquid ejecting apparatus.

2. Related Art

In recent years, a diameter of nozzles was reduced with higher density of ink jet record. However, when cartridges storing colorant containing ink are mounted on a printer having these nozzles and the printer is not used for a long time, a color material of the ink may sink and cohere in an ink tank. When the color material of the ink sinks or coheres, a problem occurs in that a colorant concentration of the ink to be ejected from the nozzles decreases. Moreover, a problem may also occur in that ink ejection is unstable due to clogging of the sinking and cohering ink.

In order to solve these problems, an ink jet printing apparatus disclosed in JP-A-2001-322297 (FIGS. 5, 6, and 7, etc.) is provided with a mixing unit inside an ink tank which stores ink. By allowing the mixing unit to mix the ink stored in the ink tank, the colorant material of the ink is prevented from sinking and cohering.

However, in the ink jet printing apparatus disclosed in JP-A-2001-322297, a unit shaking the ink tank is provided outside the ink jet printing apparatus in order to mix the ink stored in the ink tank. Accordingly, a problem may occur in that a mechanism for mixing the ink has to be additionally provided and a space for disposing the mechanism is necessary.

SUMMARY

An advantage of some aspects of the invention is that it provides a liquid ejecting apparatus capable of ensuring stable ejection of a liquid and saving a space without providing additional motive power.

According to an aspect of the invention, there is provided a liquid ejecting apparatus including: a sub-tank which stores a certain volume of liquid; a liquid ejecting head which ejects the liquid supplied from the sub-tank; a sheet feeding drum which feeds an ejection target medium to be ejected with the liquid by rotation; a liquid container which stores the liquid to be supplied to the sub-tank; and a supply passage which connects the sub-tank to the liquid container so that the liquid is supplied from the liquid container to the sub-tank. The sheet feeding drum includes a liquid container receiving chamber receiving the liquid container and the liquid container receiving chamber communicates with the supply passage.

With such a configuration, since the liquid container is received inside the sheet feeding drum, it is not necessary to provide an additional space for disposing the liquid container. Therefore, in the liquid ejecting apparatus, a space can be saved. Since the liquid container rotates together with the sheet feeding drum, it is possible to mix the liquid in the liquid container by rotating the sheet feeding drum. In addition, it is possible to mix the liquid in the liquid container by use of the motive power used to rotate the sheet feeding drum. Accordingly, it is not necessary to additionally provide a new motive power source in order to mix the liquid in the liquid container. Moreover, the mixing process can be performed in a sheet feeding process during ejection of the liquid. Accordingly, since the ejection of the liquid is not interrupted to separately perform the mixing process, it is possible to prevent deterioration in throughput.

In the liquid ejecting apparatus according to this aspect of the invention, the supply passage may have a tank passage communicating from the inside of the sub-tank to the outside of the sub-tank and a main passage communicating from the liquid container receiving chamber to an outer circumferential surface of the sheet feeding drum, and the tank passage and the main passage are provided to be contacted to each other and detached from each other.

With such a configuration, it is possible to supply the liquid by connecting the tank passage to the main passage. Accordingly, it is possible to avoid a problem that the liquid is not smoothly supplied in a case where a supply passage is twisted due to the rotation of the sheet feeding drum.

In the liquid ejecting apparatus according to this aspect of the invention, the main passage may be extracted to a non-ejection area, where the liquid ejecting head does not eject the liquid toward the sheet feeding drum, in the sheet feeding drum. With such a configuration, it is possible to supply the liquid from the liquid container to the sub-tank when the liquid ejecting head does not eject the liquid. Accordingly, stable liquid supply from the liquid container to the sub-tank is possible.

The liquid ejecting apparatus according to this aspect of the invention may further include: a supply head which is disposed at a location where the main passage is extracted; an ink sucking head which is disposed at a location where the tank passage is extracted; a sheet feeding drum driving unit which rotates the sheet feeding drum in a direction in which the supply head and the ink sucking head are faced with each other; a first pump which sends the liquid stored in the liquid container to the sub-tank; a first pump driving unit which drives the first pump; and an actuator driving unit which moves up and down the supply head. When the liquid ejecting head does not eject the liquid, the supply head and the ink sucking head are faced with each other by rotating the sheet feeding tank by drive of the sheet feeding drum driving unit, the main passage and the tank passage are connected to each other by moving up the supply head by drive of the actuator driving unit and bringing the supply head into contact with the ink sucking head, and the liquid stored in the liquid container is sent to the sub-tank by driving the first pump by drive of the first pump driving unit.

With such a configuration, it is possible to ensure a communication state between the sub-tank and the liquid container by a simple process and easily supply the liquid. In addition, since the liquid supply is possible when the liquid ejecting head does not eject the liquid, the liquid can be supplied from the liquid container to the sub-tank in a stable state.

The liquid ejecting apparatus according to this aspect of the invention may further include a cap which comes in contact with a plate member of the liquid ejecting head. The cap moves up by drive of the actuator driving unit. In addition, when the main passage is connected to the tank passage, the actuator driving unit simultaneously moves up the cap, so that the cap seals the plate member. With such a configuration, it is possible to cap the plate member when the liquid is supplied from the liquid container to the sub-tank.

The liquid ejecting apparatus according to this aspect of the invention may further include: a second pump which applies negative pressure to an airtight space formed when the cap seals the plate member; a second pump driving unit which drives the second pump; a carriage driving unit which reciprocates the liquid ejecting head in a direction perpendicular to a feeding direction of the ejection target medium; and a wiper which comes in contact with the plate member to wipe the liquid attached to the plate member. The actuator driving unit, the second pump driving unit, and the carriage driving unit are controlled by a cleaning controller. In addition, the cleaning controller sends the liquid stored in the liquid container to the sub-tank by driving the first pump, simultaneously applies the negative pressure to the airtight space by allowing the second pump driving unit to drive the second pump, moves up the wiper by driving the actuator driving unit, and moves the liquid ejecting head toward the wiper by driving the carriage driving unit to bring the wiper into contact with the plate member. With such a configuration, it is possible to clean the plate member when the liquid is supplied from the liquid container to the sub-tank.

According to the liquid ejecting apparatus according to this aspect of the invention, it is possible to save a space and ensure the stable liquid ejection without providing an additional motive power.

BRIEF DESCRIPTION OF THE DRAWINGS

The invention will be described with reference to the accompanying drawings, wherein like numbers reference like elements.

FIG. 2A is a diagram illustrating a configuration before cartridges and a sub-tank are connected and FIG. 2B is a diagram illustrating a configuration where the cartridges and the sub-tank are connected to each other.

DESCRIPTION OF EXEMPLARY EMBODIMENTS

Hereinafter, an ink jet printing apparatus 10 as a liquid ejecting apparatus will be described with reference to the drawings according to an embodiment of the invention. In the following description, in FIGS. 1, 2A, and 2B, an arrow X1 direction and an arrow X2 direction present a left direction and a right direction, respectively. An arrow Y1 direction and an arrow Y2 direction which are perpendicular to the X1 direction and X2 direction in a horizontal direction represent a front direction and a rear direction, respectively. An arrow Z1 direction and an arrow Z2 direction which are perpendicular an XY plane represent an up direction and a down direction, respectively.

Overall Configuration

Figure 1:
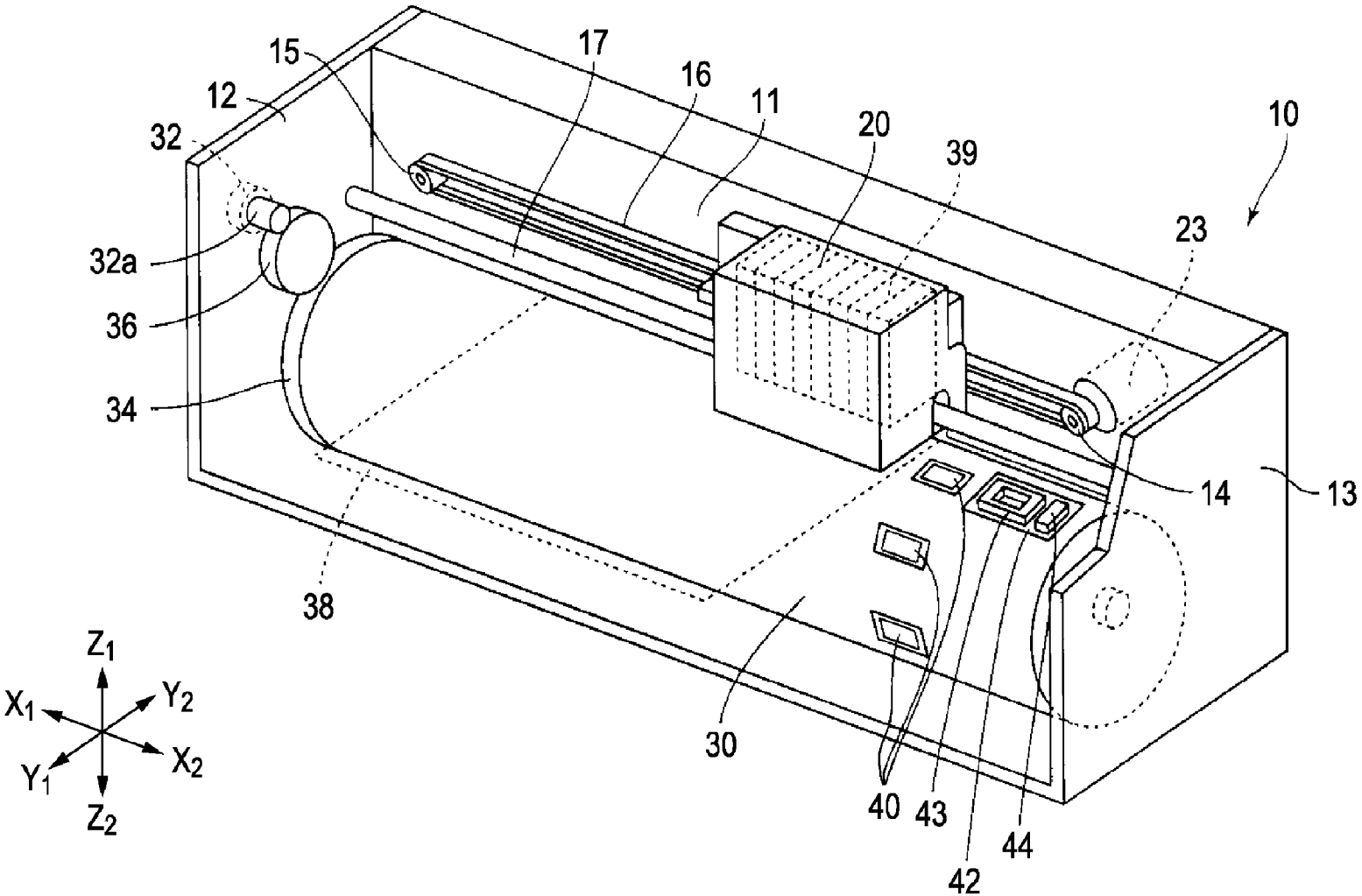
FIG. 1 is a perspective view illustrating the overall configuration of an ink jet printing apparatus as a liquid ejecting apparatus according to an embodiment of the invention.
Figure 2A:
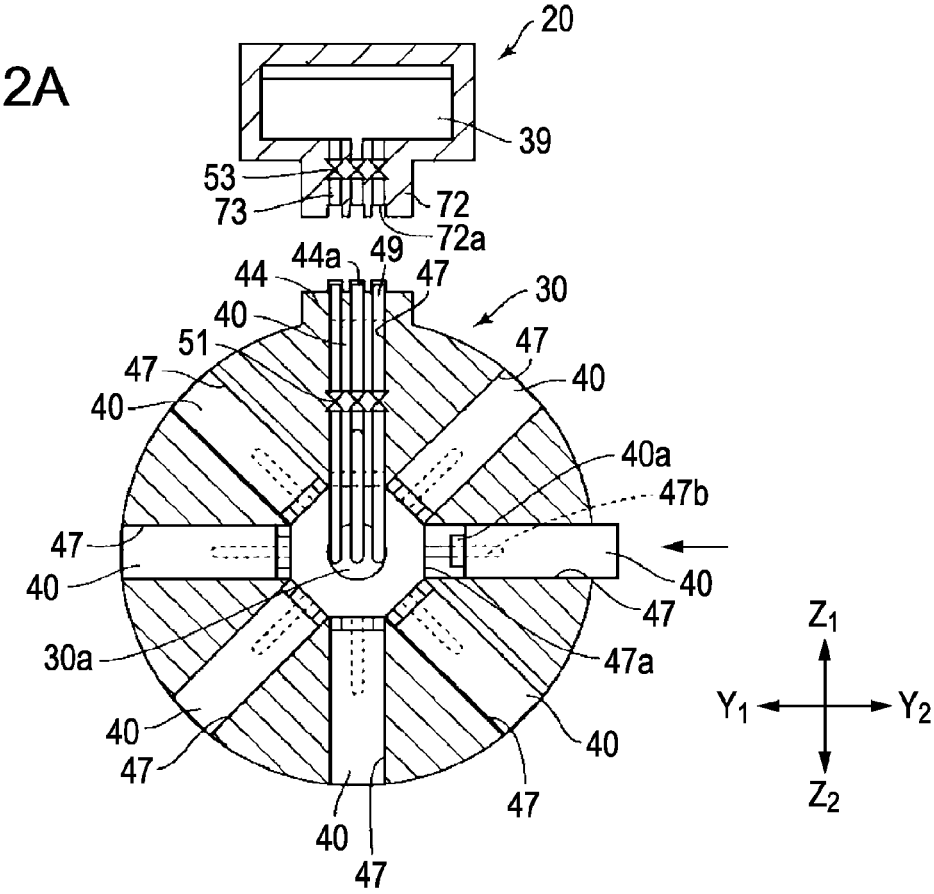
FIGS. 2A and 2B are schematic sectional views when the inner structure of a sheet feeding drum and a carriage in FIG. 1 is viewed from a side of a frame.
Figure 2B:
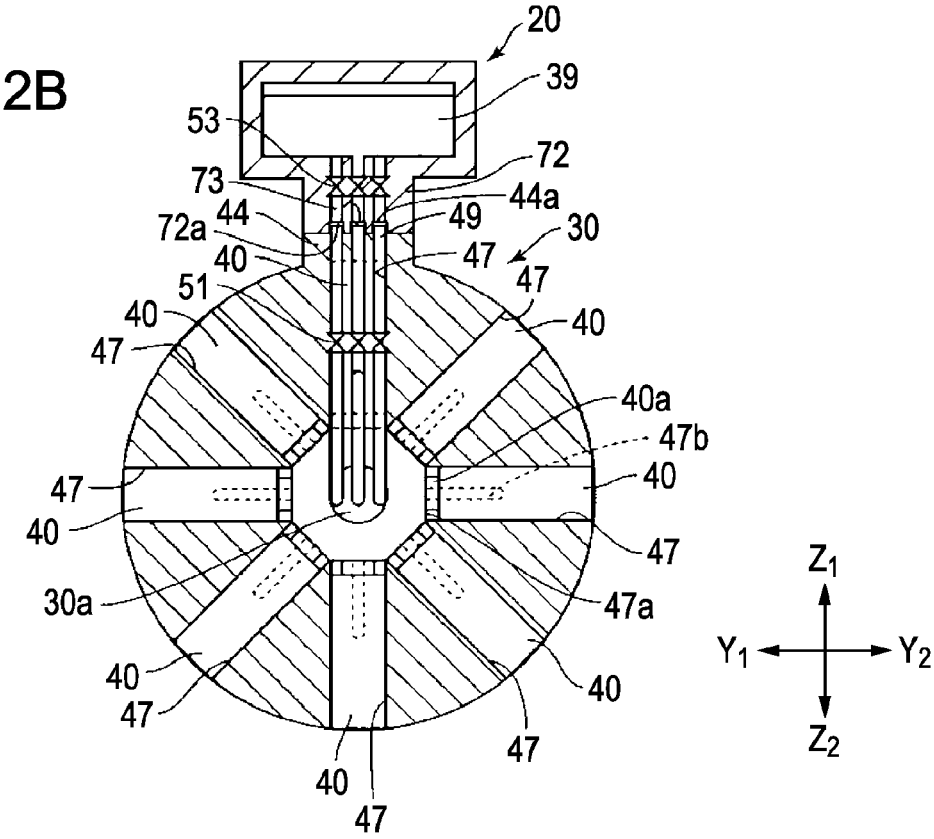

FIG. 1 is a perspective diagram illustrating the overall configuration of the ink jet printing apparatus 10 as the liquid ejecting apparatus. FIGS. 2A and 2B are schematic sectional views when the inner structure of a sheet feeding drum 30 and a carriage 20 is viewed from the side of a frame 13. FIG. 2A is a diagram illustrating a configuration before cartridges 40 and a sub-tank 39 are connected and FIG. 2B is a diagram illustrating a configuration where the cartridges 40 and the sub-tank 39 are connected to each other. Constituent elements of the liquid ejecting apparatus according to this embodiment are broadly classified into a print head driving system including a print head and various members supporting the drive of the print head and a control system including members that control operations of the print head and the various members.

As shown in FIG. 1, the ink jet printing apparatus 10 is provided with frames 11, 12, and 13 surrounding three rear, left, and right directions. A driving pulley 14 and a driven pulley 15 are provided at a location on a slight left side from the right end of the frame 11 on a rear side of a case and at a location on a slight right side from the left end of the frame 11, respectively. An endless belt 16 is suspended on both the pulleys 14 and 15. On the front side of the case, a guide member 17 is suspended between the left frame 12 and the right frame 13. A carriage 20 is connected to slide along the guide member 17. A connection member (not shown) disposed on the rear side of the carriage 20 is fixed between a predetermined location of the endless belt 16. A rotation shaft of the driving pulley 14 is connected to a shaft of a motor 23 perforated from the rear of the frame 11 to the front thereof. Therefore, when the driving pulley 14 is rotated forward or backward by the motor 23, the carriage 20 reciprocates in right and left directions along the guide member 17.

The sheet feeding drum 30 is disposed below the carriage 20. The sheet feeding drum 30 is disposed between the left frame 12 and the right frame 13 and shaft-supported by both the frames 12 and 13 so as to rotate. A rotation driving motor 32 is embedded in the left frame 12 and a rotation shaft 32*a* protrudes from the left frame 12 in the right direction. Gear grooves are formed on the outer circumferential surface of the rotation shaft 32*a*. As the rotation driving motor 32, a stepping motor can be used, for example. The sheet feeding drum 30 can be positioned at a predetermined angle by pulses given to the rotation driving motor 32. A left end of the sheet feeding drum 30 is configured as a driven portion 34 in which gear grooves are formed on the outer circumferential surface. An intermediate gear 36 is disposed between the rotation shaft 32*a* and the driven portion 34. The intermediate gear 36 is mounted so as to rotate on the left frame 13. The gear grooves of the rotation shaft 32*a* and the intermediate gear 36 engage with each other, and the gear grooves of the driven portion 34 and the intermediate gear 36 engage with each other. With such a configuration, when the rotation shaft 32*a* rotates by drive of the driving motor 32, the motive power is transferred to the driven portion 34 through the intermediate gear 36. In this way, when the motive power of the driving motor 32 is transferred to the driven portion 34, the sheet feeding drum 30 rotates. Alternatively, by forming the driven portion 34 so that the diameter is smaller than the outer diameter of the sheet feeding drum 30, the rotation shaft 32*a* and the driven portion 34 may be connected by plural gear-teeth wheels.

A counter roller (not shown) opposed to the sheet feeding drum 30 is disposed above the sheet feeding drum 30. The counter roller is pressurized toward the sheet feeding drum 30. When the sheet feeding drum 30 is rotatably driven, the counter roller also rotates. Therefore, a sheet 38 inserted on the sheet feeding drum 30 is interposed between the sheet feeding drum 30 and the counter roller to be fed toward the front side. Ink is ejected on the sheet 38 being fed on the sheet feeding drum 30 from a print head 70 described below to form an image of ink dots.

The carriage 20 includes a print head 70 (see FIG. 3) forming an image, a sub-tank 39 temporarily storing ink, an ink sucking head 72 (see FIGS. 2A and 2B) sending ink to be received on a side of the sheet feeding drum 30 to the sub-tank 39. The print head 70 and the ink sucking head 72 are both provided to protrude downward from the carriage 20 (see FIG. 3). The ink sucking head 72 is provided to be adjacent on the right side of the print head 70, for example. The print head 70 includes a nozzle plate provided with a series of nozzle openings, piezoelectric elements expanded and contracted in accordance with discharge and charge, cavities interposed between the nozzle plate and the piezoelectric elements. The sub-tank 39 has a total of eight ink chambers (not shown) in this embodiment. The ink chambers respectively stores ink of eight colors such as black, cyan, magenta, yellow, gray, light cyan, light magenta, and light gray. As shown in FIGS. 2A and 2B, the ink sucking head 72 is provided with tank passages 73 communicating with the sub-tank 39. A total of eight tank passages 73 are provided to communicate with the ink chambers of the sub-tank 39, respectively, (in FIGS. 2A and 2B, just three tank passages 73 are illustrated).

Cartridges 40 respectively storing the colors described above are disposed inside the sheet feeding drum 30. In a non-print area on the right side of the sheet feeding drum 30, the cartridges 40 are detachably mounted in a central direction from eight locations oriented in a circumferential direction of the outer circumference of the sheet feeding drum 30 (see FIGS. 2A and 2B and the like). At a location (hereinafter, the location is referred to as "an ink supply position") on the right side of the cartridges 40 in the sheet feeding drum 30, there is provided a connection unit 42 which is connected to the carriage 20 when the ink of the cartridges 40 is set to the sub-tank 39. The connection unit 42 includes a cap 43 sealing the print head 70 and a supply head 44 supplying the ink to the ink sucking head 72. The supply head 44 is provided to protrude upward from the sheet feeding drum 30 on the right side of the cap 43. The cap 43 and the supply head 44 are provided to be opposed to the print head 70 and the ink sucking head 72, respectively, in a state where the carriage 20 is located at the ink supply position. As described below, when the carriage 20 moves up to the ink supply position, the carriage 20 moves downward by a moving mechanism or the like (not shown), so that the cartridges 40 are connected to the sub-tank 39. Specifically, when the carriage 20 moves up to the ink supply position and then moved downward, the print head 70 is connected to the cap 43 and the ink sucking head 72 is simultaneously connected to the supply head 44.

As shown in FIGS. 2A and 2B, in the non-print area on the right side of the sheet feeding drum 30, a total of eight cartridge receiving chambers 47 individually receiving the cartridges 40 are provided in the circumferential direction of the sheet feeding drum 30. Since the cartridge receiving chambers 47 are present between the center of the sheet feeding drum 30 and the outer circumferential surface, the cartridge receiving chambers 47 are provided at every predetermined pitch in the circumferential direction. An ink supply needle 47*b* protruding in an opening direction is supplied in a bottom portion 47*a* of each of the cartridge receiving chambers 47. The ink supply needle 47*b* communicates with a central portion 30*a* located at the center of the sheet feeding drum 30. Main passages 49 allowing the supply of ink to the supply head 44 are formed between the communicating portion and the supply head 44. A total of eight main passages 49 are formed to allow the ink supply needles 47*b* to communicate with the supply head 44 (in FIGS. 2A and 2B, just three main passages 49 are illustrated).

The cartridges 40 of respective colors received in the sub-tank 39 are received in the cartridge receiving chambers 47, respectively. As shown in FIG. 2A, when each of the cartridges 40 is received in the each of the cartridge receiving chambers 47, an ink supply needle 47*b* is inserted into an ink introduction port 40*a* of each of the cartridges 40. Accordingly, the ink in each of the cartridges 40 can be supplied to the main passage 49 through the ink supply needle 47*b*.

As shown in FIGS. 2A and 2B, the opening end of the supply head 44 is provided with eight nozzle portions 44*a* protruding upward (in FIGS. 2A and 2B, just three nozzle portions 44*a* are illustrated). In addition, each of the main passages 49 communicates with each of the nozzle portions 44*a*. Accordingly, as shown in FIG. 2B, when the carriage 20 moves downward and the ink sucking head 72 is pushed by the supply head 44, the nozzle portions 44*a* are inserted into concave portions 72*a* of the ink sucking head 72. In this way, by inserting the nozzle portions 44*a* into the concave portions 72*a*, connection between the ink sucking head 72 and the supply head 44 is make and the main passages 49 communicate with the tank passages 73.

Since a total of eight first electromagnetic valves 51 are provided in the middle of the main passages 49 (in FIGS. 2A and 2B, just three first electromagnetic valves 51 are illustrating), the first electromagnetic valves 51 respectively open and close the main passages 49. In addition, a first sucking pump 52 (see FIG. 3) applying negative pressure to the inside of the cartridges 40 is disposed in the central portion 30*a* in which the main passages 49 gather. Since a total of eight second electromagnetic valves 53 are respectively provided in the middle of the main passages 73 (in FIGS. 2A and 2B, just three second electromagnetic valves 53 are illustrated), each of the second electromagnetic valves 53 open and close each of the tank passages 73.

When the carriage 20 moves up to the ink supply position and the print head 70 and the ink sucking head 72 are connected to the cap 43 and the supply head 44, respectively, the first electromagnetic valves 51 and the second electromagnetic valves 54 disposed in correspondence with the respective ink to be supplied open valves. In addition, the first sucking pump 52 generates negative pressure in the cartridges 40 disposed in correspondence with the ink to be supplied. Then, the ink is sucked into the cartridges 40 and reaches the supply head 44 through the ink supply needles 47*b* and the main passages 49, respectively. When the ink sucking head 72 and the supply head 44 are connected to each other, the tank passages 73 and the main passages 49 are in a connection state. Accordingly, the ink reaching the supply head 44 flows from the main passages 49 to the tank passages 73 of the ink sucking head 72 and the sub-tank 39 through the tank passages 73.

When the ink sucking head 72 and the supply head 44 are connected to each other, the print head 70 comes in contact with the cap 43. In addition, a wiper (not shown) is disposed on the left side of the cap 43. The cap 43 and the wiper function as performing a cleaning process. In this embodiment, the cleaning process can be performed at the time of ink supply. The cleaning process is performed in the following order. When the carriage 20 moves up to the ink supply position and the carriage 20 moves toward the connection unit 42 by the moving mechanism (not shown), as described above, the print head 70 is opposed to the cap 43. Then, when the cap 43 moves up by a spring mechanism or the like (not shown), the nozzle plate 74 (see FIG. 3) is sealed by the cap 43. Subsequently, by operating the second sucking pump 55 (see FIG. 3), negative pressure is applied to an airtight space formed when the nozzle plate 74 is sealed by the cap 43. In this way, the ink in the cavities of the print head 70 is sucked together with bubbles mixed in the capacities and absorbed by a waste liquid absorber 75 (see FIG. 3). When the ink is completely sucked, the negative pressure is released and the cap 43 is moved down. In addition, by moving up the wiper to the height at which the wiper touches with the nozzle plate 74, the carriage 20 is moved from the ink supply position in the left direction. At this time, when the wiper wipes the nozzle plate 74, meniscus of the ink is cleaned. Then, the cleaning process ends. In the wiping, the carriage 20 can be moved from the ink supply position in the left direction, since the connection between the ink sucking head 72 and the supply head 44 are released.

Configuration of Control Units

Figure 3:
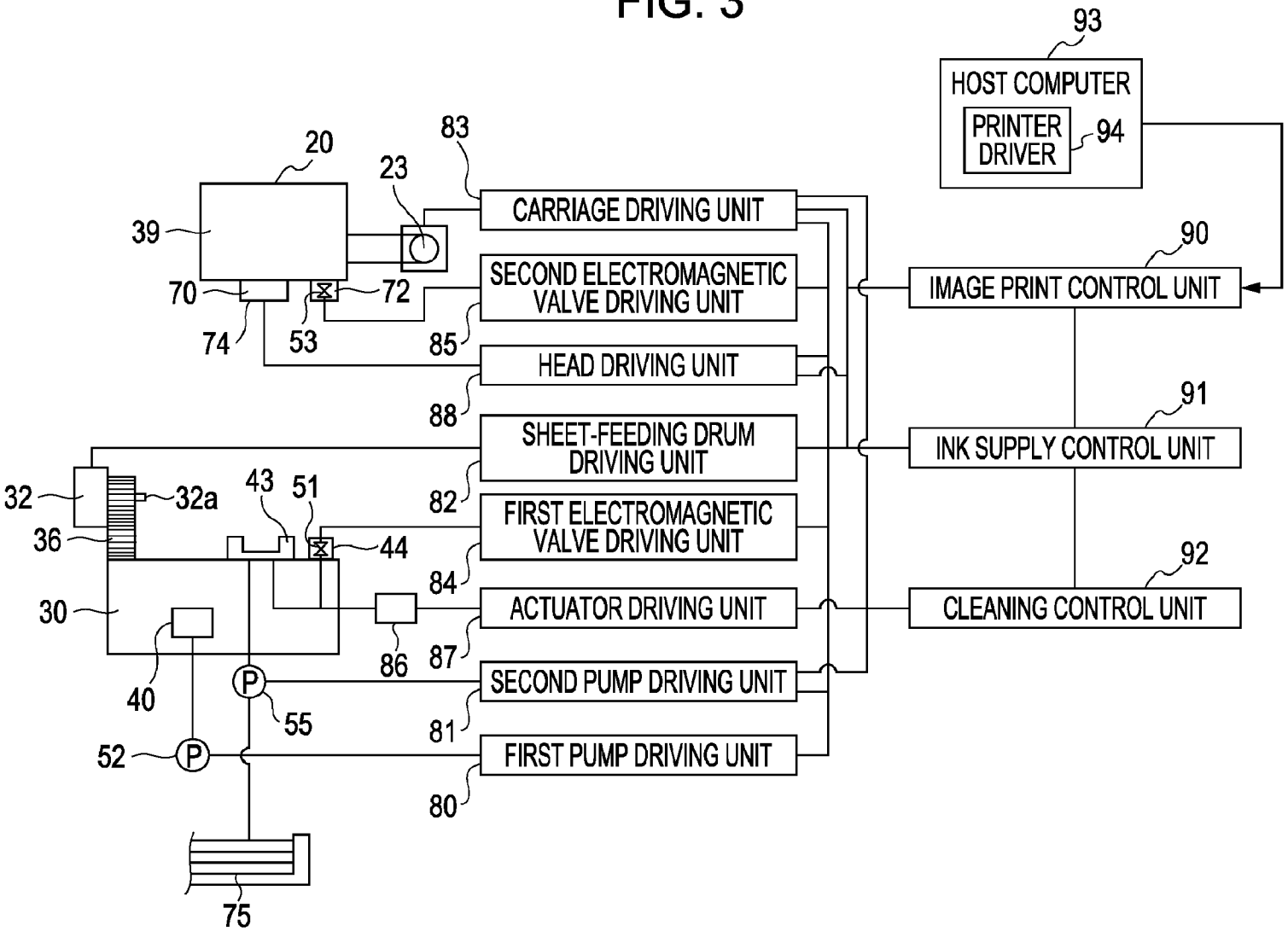
FIG. 3 is a diagram illustrating a control system of the ink jet printing apparatus in detail according to the embodiment of the invention.

FIG. 3 is a diagram illustrating the control system of the ink jet printing apparatus 10 in detail. As shown in FIG. 3, the control system of the ink jet printing apparatus 10 includes a first pump driving unit 80 which drives the first sucking pump 52, a second pump driving unit 81 which drives the second sucking pump 55 mounted separately from the first sucking pump 52, a sheet feeding drum driving unit 82 which drive the rotation driving motor 32, a carriage driving unit 83 which drives the motor 23, a first electromagnetic valve driving unit 84 which opens and closes the valves by driving the first electromagnetic valve 51, a second electromagnetic valve driving unit 85 which opens and closes the valves by driving the second electromagnetic valve 53, an actuator driving unit 87 which drives an actuator 86, a head driving unit 88 which drives the print head 70, an image print control unit 90, an ink supply control unit 91, and a cleaning control unit 92. These control units may be configured by a hardware logic such as customized ASIC (Application Specific Integrated Circuit) or by a software logic by a CPU, a RAM, and a program executed on the RAM.

Functions of the control units will be described in detail. The image print control unit 90 forms an image according to image record data on the sheet 38 by controlling the sheet feeding drum driving unit 82, the carriage driving unit 83, and the head driving unit 88. A process performed by the image print control unit 90 will be described in detail. The image print control unit 90 converts the image record data into raster data, when the image record data generated by a printer drive 94 of a host computer 93 is supplied to the image print control unit 90. Subsequently, addresses and concentration of pixels constituting the raster data are specified. In addition, a control signal for forming dots to the addresses of the pixels with the concentration is supplied to the carriage driving unit 83 and the head driving unit 88.

The image print control unit 90 calculates an amount of consumption ink on the basis of the raster data generated by the image print control unit 90. Specifically, whenever the image record data is converted into the raster data, an amount of consumption ink corresponding to one page of the raster data is calculated by counting the on-dot number of the raster data and multiplying the counted on-dot number by an amount of consumption ink per one dot. In addition, the image print control unit 90 supplies a signal indicating the calculated amount of consumption ink to the ink supply control unit 91.

The ink supply control unit 91 is a module which intermittently supplies ink from the cartridges 40 to the sub-tank 39. A memory of the ink supply control unit 91 has an area for storing remaining ink Vs of the sub-tank 39 and an area for storing remaining ink Vm of each of the cartridges 40. In addition, the ink supply control unit 91 subtracts the amount of consumption ink from the remaining ink Vs, whenever the signal indicating the amount of consumption ink is supplied from the image print control unit 90. When the remaining ink Vs is less than a threshold value, a routine of supplying the ink of the cartridges 40 to the sub-tank 39 and subtracting the supply amount from the remaining ink Vm is repeatedly performed by controlling the first pump driving unit 80, the second pump driving unit 81, the sheet feeding drum driving unit 82, the carriage driving unit 83, the first electromagnetic valve driving unit 84, the second electromagnetic valve driving unit 85, and the actuator driving unit 87.

The cleaning control unit 92 is a module which performs the cleaning process. The cleaning control unit 92 simultaneously controls the cleaning process to start, when the ink is supplied by control of the ink supply control unit 91. The cleaning control unit 92 sequentially supplies the carriage driving unit 83, the actuator driving unit 87, and the second pump driving unit 81 with control signals for a series of processes of moving up the cap 43, applying the negative pressure, releasing the negative pressure state, moving down the cap 43, moving up the wiper, and moving the carriage 20 to the outside of a home position, which are described above.

Process Flow of Ink Supply Control Unit

Figure 4:
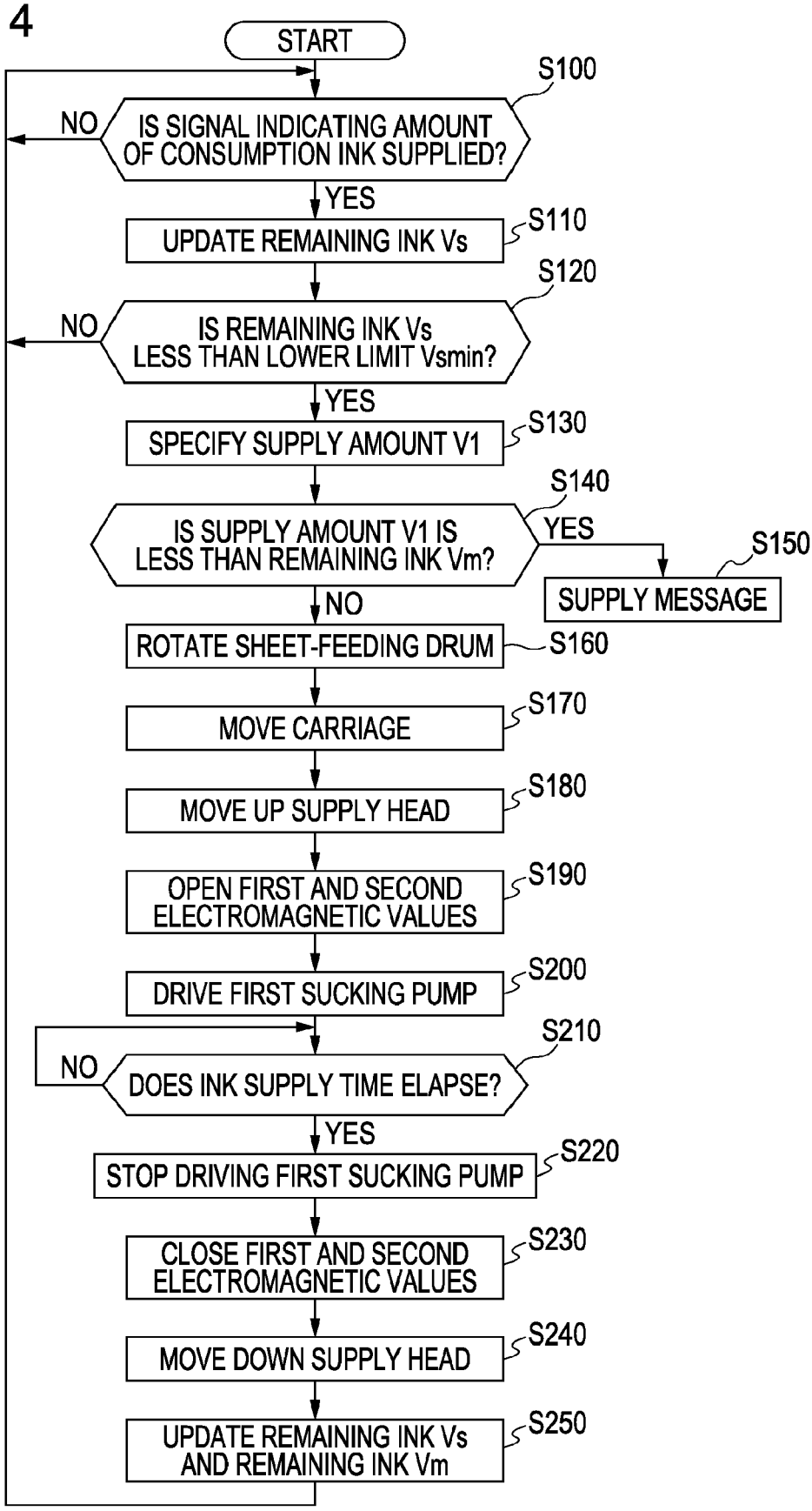
FIG. 4 is a flowchart illustrating a process performed by an ink supply control unit.

Processes performed by the ink supply control unit 91 are described in detail with reference to FIG. 4. FIG. 4 is a flowchart illustrating the processes performed by the ink supply control unit 91. A series of processes illustrated in FIG. 4 are performed, when the signal indicating the amount of consumption ink is supplied from the image print control unit 90 (S100: Yes). The ink supply control unit 91 receiving the signal indicating the amount of consumption ink stored in the memory of the ink supply control unit 91 updates the remaining ink Vs into a new value obtained by reducing the remaining ink Vs by the amount of consumption ink indicated by the signal (S110). Subsequently, the ink supply control unit 91 determines whether the updated remaining ink Vs is less than a lower limit value Vsmin (S120). The lower limit value Vsmin of the remaining ink refers to a lower limit value of the capacity of the sub-tank 39 with which ink droplets can be ejected without supply of ink and is set to a value of remaining ink in which bubbles do not enter the cavities of the print head 70.

When the ink supply control unit 91 determines that the remaining ink Vs is not less than the lower limit value Vsmin (S120: No), the process returns to S100 and the ink supply control unit 91 waits a new signal. Alternatively, when the ink supply control unit 91 determines that the remaining ink Vs is less than the lower limit value Vsmin (S120: Yes), the ink supply control unit 91 specifies an ink supply amount Vl to be supplied to the sub-tank 39 (S130). The ink supply amount Vl refers to an amount of ink necessary for filling the sub-tank 39 and is calculated from a relation (difference) between the lower limit value Vsmin of the above-described remaining ink and an amount of ink necessary for fully filling the sub-tank 39.

The ink supply control unit 91 specifying the ink supply amount Vl compares the ink supply amount Vl to the remaining ink Vm of the cartridge 40 stored in the memory of the ink supply control unit 91 (S140). That is, in Step S140, it is determined whether ink more than the ink supply amount Vl remains in the cartridge 40. In Step S140, when the ink supply control unit 91 determines that the remaining ink Vm is less than the ink supply amount Vl (S140: Yes), the ink supply control unit 91 supplies a message prompting exchange of the cartridge 40 to the host computer 93 (S150).

Alternatively, when the ink supply control unit 91 determines that the remaining ink Vm is more than the ink supply amount Vl (S140: No), the ink supply control unit 91 supplies the sheet feeding drum driving unit 82 with a control signal for rotating the sheet feeding drum 30 so that the supply head 44 and the print head 70 are opposed to each other (S160). The sheet feeding drum driving unit 82 receiving the control signal drives the rotation driving motor 32 to rotate the sheet feeding drum 30 so that the supply head 44 is opposed to the print head 70. Subsequently, the ink supply control unit 91 supplies a control signal for moving the carriage 20 to the ink supply position to the carriage driving unit 83 (S170). Subsequently, the carriage driving unit 83 moves the carriage 20 up to the ink supply position by driving the motor 23.

Subsequently, the ink supply control unit 91 supplies a control signal for moving up the supply head 44 to the actuator driving unit 87 (S180). The actuator driving unit 87 receiving the control signal moves up the supply head 44. Then, the ink sucking head 72 and the supply head 44 are connected to each other in an airtight manner.

The ink sucking head 72 and the supply head 44 are connected to each other and ink supply control unit 91 supplies the first electromagnetic valve driving unit 84 and the second electromagnetic valve driving unit 85 with a control signal for opening the first electromagnetic valve 51 and the second electromagnetic valve 53 corresponding to each ink (S190). Then, the first electromagnetic valve driving unit 84 and the second electromagnetic valve driving unit 85 open the first electromagnetic valve 51 and the second electromagnetic valve 53, respectively. In this way, each of the cartridges 40 and the sub-tank 39 communicate with each other.

Subsequently, the ink supply control unit 91 supplies a control signal for driving the first sucking pump 52 to the first pump driving unit 80 (S200). Then, the first pump driving unit 80 allows generating the negative pressure in each of the cartridges 40 by driving the first sucking pump 52. In this way, the ink is supplied from each of the cartridges 40 to the sub-tank 39.

The ink supply control unit 91 waits a predetermined ink supply time. When the predetermined ink supply time elapse (S210: Yes), the ink supply control unit 91 stops the drive of the first sucking pump 52 (S220). The predetermined ink supply time refers to time necessary for refilling the sub-tank 39, where amount of ink is leas than the lower limit value Vsmin, with the ink. The predetermined ink supply time is calculated from the ink supply amount per time unit which is supplied from each of the cartridges 40 to the sub-tank 39, the lower limit value Vsmin, and the capacity of the sub-tank 39.

Subsequently, the ink supply control unit 91 supplies a control signal for closing the first electromagnetic valve 51 and the second electromagnetic valve 53 to the first electromagnetic valve driving unit 84 and the second electromagnetic valve driving unit 85, respectively (S230). Then, the first electromagnetic valve driving unit 84 and the second electromagnetic valve driving unit 85 close the first electromagnetic valve 51 and the second electromagnetic valve 53, respectively. In this way, the communication state between each of the cartridges 40 and the sub-tank 39 is released.

Subsequently, the ink supply control unit 91 supplies a control signal for moving down the supply head 44 to the actuator driving unit 87 (S240). Then, the actuator driving unit 87 moves down the supply head 44. In this way, the connection between the sub-tank 39 and the carriage 20 is released by separating the ink sucking head 72 and the supply head 44 from each other.

Subsequently, the ink supply control unit 91 updates the remaining ink Vs stored in the memory of the ink supply control unit 91 into a value such as the capacity of the sub-tank 39 and simultaneously updates the remaining ink Vm into a value obtained by reducing the remaining ink Vm by an amount of ink supplied from each of the cartridges 40 to the sub-tank 39 (S250). Next, the process returns to Step S100. That is, the remaining ink Vs is reset to an initial value. Whenever a signal indicating the amount of consumption ink is supplied from the image print control unit 90, the subsequent processes are repeatedly performed.

Advantages of the Invention

In the ink jet printing apparatus 10 having the above-described configuration, it is not necessary to provide an additional space for disposing the cartridges 40, since the cartridges 40 are received inside the sheet feeding drum 30. Accordingly, it is possible to save a space in the ink jet printing apparatus 10.

In the ink jet printing apparatus 10, the cartridges 40 rotate together with the sheet feeding drum 30. Accordingly, by rotating the sheet feeding drum 30, the ink of the cartridges 40 can be mixed. The ink of the cartridges 40 can be mixed by use of the motive power of the rotation driving motor 32 rotating the sheet feeding drum 30. Accordingly, it is not necessary to additionally provide a new motive power in order to mix the ink of the cartridges 40. In addition, since an ink mixing process can be performed in a sheet feeding process, the ink is mixed separately from the printing process. Therefore, since the printing process is not interrupted, it is possible to prevent deterioration in throughput.

In the ink jet printing apparatus 10, the ink is configured to be supplied through the main passages 49 and the tank passages 73 by moving the carriage 20 up to the ink supply position, moving up the supply head 44, and connecting the ink sucking head 72 of the sub-tank 39 to the supply head 44 of the cartridges 40. Accordingly, it is possible to stably supply the ink from the cartridges 40 to the sub-tank 39, compared to a case where the cartridges 40 and the sub-tank 39 are connected to each other through a tube or the like.

In the ink jet printing apparatus 10, supply nozzles are provided in the non-print area of the sheet feeding drum 30. With such a configuration, the supply of ink from the cartridges 40 to the sub-tank 39 is performed when the ink is not ejected. Accordingly, it is possible to stably supply the ink from the cartridges 40 to the sub-tank 39.

Modified Example of the Invention

Hereinafter, the embodiment of the invention has been described. The invention is not limited to the embodiment described above, but may be modified in various forms.

In embodiment described above, the cartridges 40 are configured to be mounted in the central direction from the outside of a diameter direction of the sheet feeding drum 30. However, the configuration in which the cartridges 40 are received is not limited to this configuration. For example, the cartridges 40 may be mounted toward the right surface of the sheet feeding drum 30 from the right side of the sheet feeding drum 30.

In embodiment described above, the eight kinds of cartridge 40 received in the sheet feeding drum 30 are used, but seven kinds of a cartridge may be used, and nine or more kinds of a cartridge may be used.

In embodiment described above, the first sucking pump 52 is used in order to send the ink from the cartridges 40 to the sub-tank 39. However, as a configuration for sending the ink, there may be used the configuration in which the cartridge receiving chambers 47 inside the ink from the cartridges 40 are pressurized and ink packs provided inside the cartridge receiving chambers 47 are compressed, instead of the configuration in which the ink of the cartridges 40 is sucked by the negative pressure.

In embodiment described above, the location on the right side of a movable range of the carriage 20 is configured as the ink supply position, but a location on the left side of a movable range of the carriage 20 may be configured as the ink supply position.

In embodiment described above, the electromagnetic valves 51 and 53 are provided in both sides of the sub-tank 39 and the cartridges 40, but may be provided only one of both the sides.

In embodiment described above, the ink jet printing apparatus 10 has been described as the liquid ejecting apparatus. The liquid ejecting apparatus is not limited to the ink jet printing apparatus 10, but may be applied to a copier machine having a copy function, for example. In addition, another example of the liquid ejecting apparatus includes an apparatus which ejects a liquid and is used to manufacture a liquid crystal display, an EL display, and the like. The liquid may not be a liquid other than ink. For example, a color material or an electrode material is used as a liquid in an apparatus which eject a liquid used in a liquid crystal display and an EL display.

What is claimed is:

1. A liquid ejecting apparatus comprising:

a sub-tank which stores a certain volume of liquid;

a liquid ejecting head which ejects the liquid supplied from the sub-tank;

a sheet feeding drum which feeds an ejection target medium to be ejected with the liquid by rotation;

a liquid container which stores the liquid to be supplied to the sub-tank; and a supply passage which connects the sub-tank to the liquid container so that the liquid is supplied from the liquid container to the sub-tank, wherein the sheet feeding drum includes a liquid container receiving chamber receiving the liquid container and the liquid container receiving chamber communicates with the supply passage, and wherein the liquid container rotates together with the sheet feeding drum.

2. The liquid ejecting apparatus according to claim 1, wherein the supply passage has a tank passage communicating from the inside of the sub-tank to the outside of the sub-tank and a main passage communicating from the liquid container receiving chamber to an outer circumferential surface of the sheet feeding drum, and the tank passage and the main passage are provided to be contacted to each other and detached from each other.

3. The liquid ejecting apparatus according to claim 2, wherein the main passage is extracted to a non-ejection area, where the liquid ejecting head does not eject the liquid toward the sheet feeding drum, in the sheet feeding drum.

4. The liquid ejecting apparatus according to claim 2, further comprising:

a supply head which is disposed at a location where the main passage is extracted;

an ink sucking head which is disposed at a location where the tank passage is extracted;

a sheet feeding drum driving unit which rotates the sheet feeding drum in a direction in which the supply head and the ink sucking head are faced with each other;

a first pump which sends the liquid stored in the liquid container to the sub-tank;

a first pump driving unit which drives the first pump; and an actuator driving unit which moves up and down the supply head, wherein when the liquid ejecting head does not eject the liquid, the supply head and the ink sucking head are faced with each by rotating the sheet feeding tank by drive of the sheet feeding drum driving unit, the main passage and the tank passage are connected to each other by moving up the supply head by drive of the actuator driving unit and bringing the supply head into contact with the ink sucking head, and the liquid stored in the liquid container is sent to the sub-tank by driving the first pump by drive of the first pump driving unit.

5. The liquid ejecting apparatus according to claim 2, further comprising a cap which comes in contact with a plate member of the liquid ejecting head, wherein the cap moves up by drive of the actuator driving unit, and when the main passage is connected to the tank passage, the actuator driving unit simultaneously moves up the cap, so that the cap seals the plate member.

6. The liquid ejecting apparatus according to claim 5, further comprising:

a second pump which applies negative pressure to an airtight space formed when the cap seals the plate member;

a second pump driving unit which drives the second pump;

a carriage driving unit which reciprocates the liquid ejecting head in a direction perpendicular to a feeding direction of the ejection target medium; and a wiper which comes in contact with the plate member to wipe the liquid attached to the plate member, wherein the actuator driving unit, the second pump driving unit, and the carriage driving unit are controlled by a cleaning controller, and wherein the cleaning controller sends the liquid stored in the liquid container to the sub-tank by driving the first pump, simultaneously applies the negative pressure to the airtight space by allowing the second pump driving unit to drive the second pump, moves up the wiper by driving the actuator driving unit, and moves the liquid ejecting head toward the wiper by driving the carriage driving unit to bring the wiper into contact with the plate member.

7. The liquid ejecting apparatus according to claim 1, wherein the liquid container receiving chamber is provided in the circumferential direction of the sheet feeding drum.

* * * * *